US008213626B2

(12) United States Patent
Weidner

(10) Patent No.: US 8,213,626 B2
(45) Date of Patent: Jul. 3, 2012

(54) MEASURING BOX FOR A HEARING APPARATUS AND CORRESPONDING MEASURING METHOD

(75) Inventor: Tom Weidner, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1447 days.

(21) Appl. No.: 11/804,153

(22) Filed: May 17, 2007

(65) Prior Publication Data

US 2007/0269051 A1 Nov. 22, 2007

(30) Foreign Application Priority Data

May 19, 2006 (DE) ..... 10 2006 023 735

(51) Int. Cl.
*H04R 29/00* (2006.01)

(52) U.S. Cl. ..... 381/60; 381/58

(58) Field of Classification Search ..... 381/58, 381/60, 71.8; 702/183
See application file for complete search history.

(56) References Cited

U.S. PATENT DOCUMENTS

| | | | | |
|---|---|---|---|---|
| 5,040,156 | A | 8/1991 | Föller | |
| 5,974,155 | A | 10/1999 | Kashani et al. | |
| 6,119,808 | A | 9/2000 | Steedman et al. | |
| 6,603,860 | B1 * | 8/2003 | Taenzer et al. | 381/60 |
| 6,671,643 | B2 | 12/2003 | Kachler et al. | |
| 6,760,451 | B1 * | 7/2004 | Craven et al. | 381/98 |
| 7,020,581 | B2 * | 3/2006 | Dittberner | 702/183 |
| 7,058,182 | B2 * | 6/2006 | Kates | 381/60 |
| 7,536,018 | B2 * | 5/2009 | Onishi et al. | 381/71.8 |
| 7,706,547 | B2 * | 4/2010 | Luo et al. | 381/71.8 |
| 2004/0208330 | A1 | 10/2004 | Chalupper et al. | |
| 2005/0123145 | A1 * | 6/2005 | Kuhnel | 381/60 |
| 2006/0093174 | A1 | 5/2006 | Niederdrank et al. | |

FOREIGN PATENT DOCUMENTS

| | | | |
|---|---|---|---|
| DE | 39 21 307 | C2 | 1/1991 |
| DE | 10046098 | C1 | 4/2002 |
| DE | 102004051226 | B3 | 1/2006 |
| EP | 1453358 | A2 | 9/2004 |
| JP | 2000179068 | A | 6/2000 |
| WO | WO9847133 | A1 | 10/1998 |

* cited by examiner

*Primary Examiner* — Davetta W Goins
*Assistant Examiner* — Phan Le

(57) ABSTRACT

The size of measuring boxes for hearing apparatuses and in particular for hearing devices is to be reduced, with the efficiency of the measuring box in respect of attenuating interference noises being maintained or improved. A measuring box is thus proposed, which comprises an interference signal recording facility for recording an interference signal. Furthermore, provision is made in the measuring box for a signal generating facility to generate a compensation signal which is phase-opposed to the recorded interference signal, so that the interference signal can be compensated for by the compensation signal. The interference noise attenuation is thus achieved here by an electronic active part, so that the quality demands on the measurement space can be reduced and its size thereby decreased as well.

6 Claims, 2 Drawing Sheets

MEASURING BOX FOR A HEARING APPARATUS AND CORRESPONDING MEASURING METHOD

CROSS REFERENCE TO RELATED APPLICATIONS

This application claims priority of German application No. 10 2006 023 735.8 filed May 19, 2006, which is incorporated by reference herein in its entirety.

FIELD OF THE INVENTION

The present invention relates to a measuring box for a hearing apparatus having a housing, into which the hearing apparatus to be calibrated can be inserted. Furthermore, the present invention relates to a corresponding method for calibrating a hearing apparatus and in particular a hearing device.

BACKGROUND OF THE INVENTION

Hearing devices must be adjusted prior to their use. To this end, they are calibrated in a defined acoustic environment. For this purpose, a so-called measuring box is generally used, the main task of which consists in attenuating ambient noises. A successful and reliable measurement is actually only possible by means of this noise attenuation.

Measuring boxes are usually designed such that the ambient noises are "screened out" by means of the mass and impermeability of the respective box. A passive attenuation thus takes place. This nevertheless leads to excessively large and heavy measuring boxes. In the case of smaller measuring systems, such as can be found in hearing device measuring systems for hearing device acousticians, adequate attenuation of the ambient noises is not possible as a result of the required minimal installation size and mass of the measuring box used there.

SUMMARY OF THE INVENTION

The object of the present invention thus consists in proposing the smallest possible measuring box which ensures an adequately effective attenuation.

This object is achieved in accordance with the invention by a measuring box for a hearing apparatus having a housing, into which the hearing apparatus to be calibrated can be inserted, an interference signal recording facility for recording an interference signal and a signal generating facility for generating a compensation signal which is phase-opposed to the recorded interference signal, so that the interference signal can be compensated for by the compensation signal.

Furthermore, provision is made in accordance with the invention for a method for calibrating a hearing apparatus in a measuring box by recording an interference signal on/in the measuring box and generating a compensation signal which is phase-opposed the recorded interference signal, so that the interference signal is compensated for by the compensation signal.

The concept underlying the invention is not to exclusively implement the attenuation in a passive manner, as is the case with the prior art. An active attenuation of the ambient noises is instead to be carried out. This enables very small and light-weight measuring boxes to be developed, which nevertheless exhibit very high interference resistance in respect of ambient noises. In particular, the quality of critical measurements on hearing devices, such as background noises or the transmission behavior in the case of quiet input signals, can be significantly improved by means of this method.

The interference signal and the compensation signal are preferably of an acoustic nature and the interference signal recording facility comprises a microphone, whereas the signal generating facility comprises a loudspeaker. Acoustic interference noises can thus be effectively suppressed.

Alternatively or in addition, it can be the case that the interference signal is of an electromagnetic nature, so that the compensation signal also has to be electromagnetic. In this case, the interference signal recording facility comprises a receiving coil and the signal generating facility comprises a transmitting coil. Electromagnetic interferences from the environment can thus be effectively compensated for in the measuring box.

With a special embodiment of the measuring box according to the invention, provision can be made for the signal generating facility to also generate a measurement signal and for the compensation signal to be added to the measurement signal. In this way, a single loudspeaker or a single transmitter coil respectively can be used for both signals.

The interference signal recording facility can be arranged in the housing. The interference signal can be directly recorded in this way in the measuring box, so that the acoustic or electromagnetic path through the measuring box does not need to be modeled.

The interference signal recording facility can however also be arranged outside the housing and can comprise a corresponding filter unit. This variant enables the size of the measuring box to be reduced further.

BRIEF DESCRIPTION OF THE DRAWINGS

The present invention is now described in more detail with reference to the appended drawings, in which.

DETAILED DESCRIPTION OF THE INVENTION

The exemplary embodiments illustrated in more detail below represent preferred embodiments of the present invention.

According to the basic concept of the present invention, the ambient noise attenuation is achieved by means of a measuring box having an active system. A system of this type is shown schematically in FIG. 1. The system is to generate an inversely phased signal in the interior of the measuring box, said signal otherwise corresponding precisely to the ambient noise N permeating into the measuring box, said ambient noise N originating from the interference sound source 1.

Figure 3:
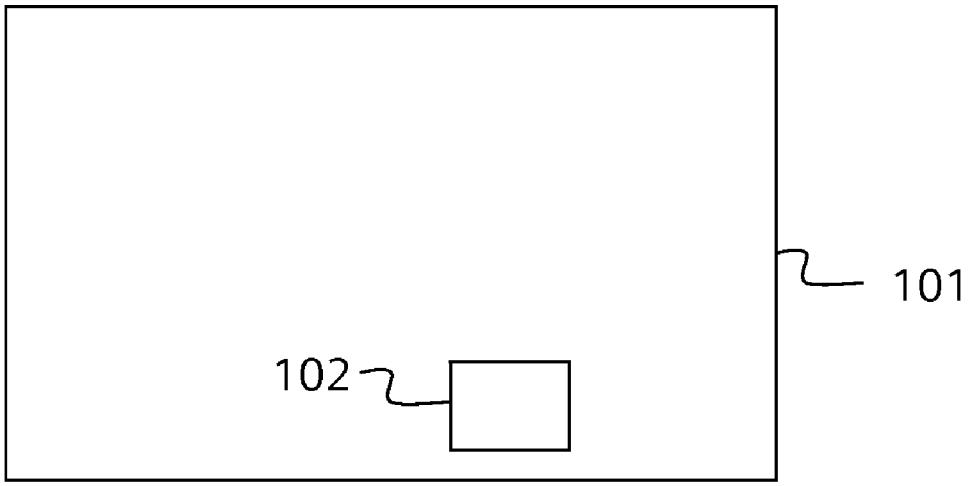
FIG. 3 shows a measuring box with a hearing apparatus inserted inside.

FIG. 3 illustrates a measuring box 1 having a hearing apparatus inserted therein.

The overall measuring box not only comprises a passive measurement space 2 here, but also an active electronics part 3, which can be referred to as an ambient noise reduction unit. This active part 3 records a signal of a reference or sound field microphone 4, which is positioned in the measurement space 2. The microphone signal is exclusively fed in the active part 3 to a control unit 5 including an adaptive filter. The output signal of the control unit 5 is forwarded to an amplifier 6 and is fed back from there to the control unit within the active part 3. The output signal of the amplifier 6 is used to control a loudspeaker 7, which is arranged in the measurement space 2.

On the basis of the interference sound N, which is recorded by the microphone 4 at the measuring or reference point in the measurement space 2, a signal —N, which is phase-opposed to the interference sound N, is generated in the measurement space with the aid of the interference noise reduction unit 3 and the loudspeaker 7. The interfering ambient noise at the measurement site 8 is herewith quenched.

Figure 1:
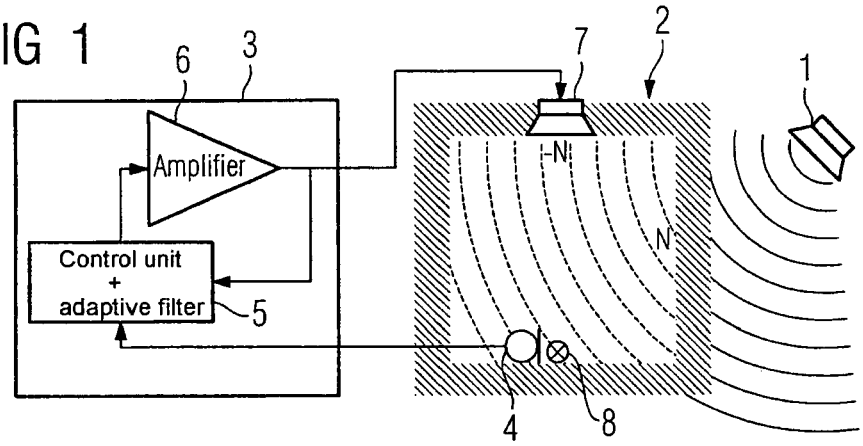
FIG. 1 shows a simplified diagram of a measuring box according to the invention for the case in which no wanted signal is applied.

The interference noise N is compensated for and quenched according to the example in FIG. 1 by means of a monitoring microphone 4, which records the ambient sound at the measuring point 8. Alternatively or in addition, an ambient microphone can also be attached to the exterior of the measuring box or of the measurement space 2 respectively, said ambient microphone continually measuring the ambient noises (cf. FIG. 2).

This method and respectively measuring system presented with reference to FIG. 1 is particularly suited to noise measurements, since a test signal need not be generated there simultaneously. In such cases only the background noises of a hearing device for instance are to be measured in a noise-free environment.

Figure 2:
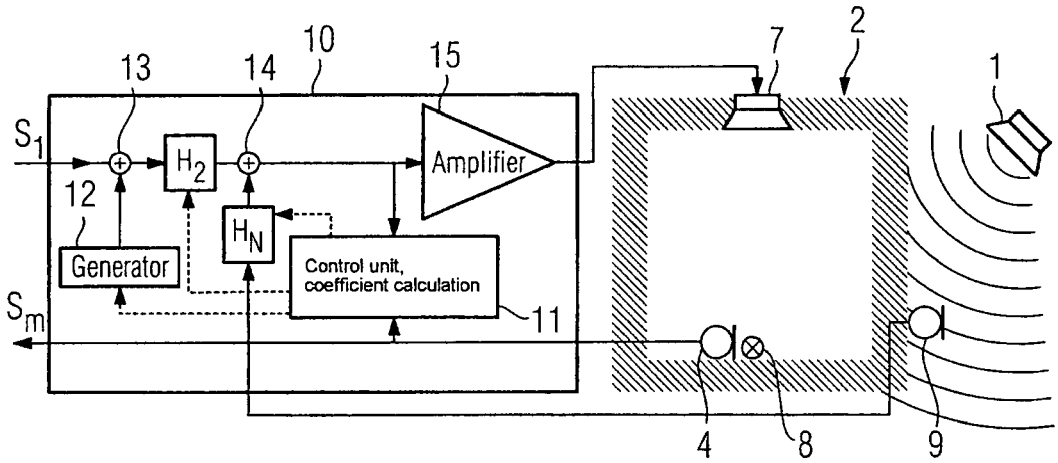
FIG. 2 shows a simplified diagram of a measuring box for the simultaneous application of a wanted signal.

The significantly more complex case would be the reduction of the ambient noise whilst simultaneously applying a test signal. A measuring box which is suited to this situation is depicted in FIG. 2. A measuring microphone 4 is also arranged here in the measurement space 2 of the measuring box, said measuring microphone measuring the sound at the measurement point 8. The measurement signal $S_m$ of the measuring microphone 4 is on the one hand directed outwards and is fed on the other hand to a control unit 11 within an active part 10 for ambient noise suppression purposes.

A wanted signal $S_1$ is supplied by way of an input of the active part 10. A generator 12 generates a compensation signal and is to this end controlled by the control unit 11, which supplies a corresponding coefficient. The output signal of the generator 12 is applied to the wanted signal $S_1$ in an adder 13. The total signal is fed to a filter $H_2$, which is used to compensate for said wanted signal portion, which still arrives at the exterior microphone 9. The filter $H_2$ is likewise controlled by the control unit 11 with corresponding coefficients.

The exterior microphone 9 first and foremost records the interference sound from the interference sound source 1. The output signal of the exterior microphone 9 is fed in the active part 10 to a further filter $H_N$. This filter $H_N$ is used to reduce the interference signal level, since this is higher on the outside than in the interior of the measurement space 2. This filter also contains its coefficients from the control unit 11.

The output signals of the two filters $H_2$ and $H_N$ are added in an adder 14 and the total signal is fed to an amplifier 15 as well as to the control unit 11. The output signal of the amplifier 15 is also used to control the loud speaker 7.

The recorded ambient noise is thus added here to the actual wanted signal $S_1$ by way of a special filter $H_N$ but is also fed separately into the measurement space 2. Such cases can involve both a quasi static (calibrated) system, with which the interference sound is always the same, or an adaptive, self-controlling system, with which the filter is permanently adjusted.

If coils are used in place of the microphone 4 and the loudspeaker 7, electromagnetic interferences from the environment can also be compensated for. The coils can naturally also be used at the same time as the microphone—loudspeaker system, so that both an acoustic and an electromagnetic compensation can be implemented. The electromagnetic measurements and respectively compensations dispense with the need for a complex and expensive electromagnetic shielding of the measuring box.

By using an additional microphone 9 and an additional coil respectively besides the measurement microphone 4 and a measurement coil respectively for directly capturing the interference signal, the risk no longer exists, when reducing the interferences, of parts of the wanted signal and test signal respectively being quenched.

The invention claimed is:

1. A measuring box for calibrating a hearing apparatus insertable into the measuring box, comprising:

an interference signal recording device that records an interference signal originating from an interference sound source arranged at an interior and/or exterior side of the measuring box; and a signal generating device that generates a compensation signal in the interior of the measuring box that is phase-opposed to the recorded interference signal, such that the generated compensation signal provides a compensation for the interference signal permeating into the interior of the measuring box, wherein the interference signal and the compensation signal comprise both acoustic and electromagnetic signals, wherein the interference signal recording device comprises a microphone and a receiving coil, and wherein the signal generating device comprises a loudspeaker and a transmitting coil.

2. The measuring box as claimed in claim 1, wherein the signal generating device further generates a measuring signal that is added to the compensation signal.

3. The measuring box as claimed in claim 1, wherein the interference signal recording device further comprises a filter for reducing a level of the interference signal and fed the filtered signal to the signal generating device.

4. A method for calibrating a hearing apparatus insertable in a measuring box, comprising:

recording an interference signal originating from an interference sound source by an interference signal recording device arranged at an interior and/or exterior side of the measuring box;

generating a compensation signal in the interior of the measuring box by a signal generating device that is phase-opposed to the recorded interference signal to, such that the generated compensation signal provides a compensation for the interference signal permeating into the interior of the measuring box; and calibrating the hearing apparatus in the measuring box having the compensated interference signal, wherein the interference signal and the compensation signal comprise both acoustic and electromagnetic signals, wherein the interference signal recording device comprises a microphone and a receiving coil, and wherein the signal generating device comprises a loudspeaker and a transmitting coil.

5. The method as claimed in claim 4, further comprising generating a measurement signal and adding the measurement signal to the compensation signal.

6. The method as claimed in claim 4, wherein the interference signal is filtered for generating the compensation signal.

* * * * *